US010439309B2

(12) United States Patent
Ju et al.

(10) Patent No.: US 10,439,309 B2
(45) Date of Patent: Oct. 8, 2019

(54) ELECTRICAL CONNECTOR PREVENTING A TERMINAL FROM BEING DAMAGED BY EXCESS EXTRUSION

(71) Applicant: LOTES CO., LTD, Keelung (TW)

(72) Inventors: Ted Ju, Keelung (TW); Jun Wang, Keelung (TW); Yong Quan Wu, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/868,279

(22) Filed: Jan. 11, 2018

(65) Prior Publication Data

US 2019/0067854 A1 Feb. 28, 2019

(30) Foreign Application Priority Data

Aug. 23, 2017 (CN) ..... 2017 1 0728828

(51) Int. Cl.
*H01R 12/72* (2011.01)
*H01R 13/115* (2006.01)
(Continued)

(52) U.S. Cl.
CPC ..... *H01R 12/727* (2013.01); *H01R 12/725* (2013.01); *H01R 13/113* (2013.01);
(Continued)

(58) Field of Classification Search
CPC .. H01R 12/727; H01R 12/725; H01R 13/113; H01R 13/115; H01R 13/46;
(Continued)

(56) References Cited

U.S. PATENT DOCUMENTS 4,354,724 A * 10/1982 Jarmy ..... H01R 13/645 439/681
5,482,470 A * 1/1996 Atsumi ..... H01R 13/41 439/246

(Continued)

FOREIGN PATENT DOCUMENTS

CN 2674676 Y 1/2005
CN 2886857 Y 4/2007

*Primary Examiner* — Travis S Chambers
(74) *Attorney, Agent, or Firm* — Locke Lord LLP; Tim Tingkang Xia, Esq.

(57) ABSTRACT

An electrical connector includes a body, multiple terminals and a shell. The body includes a mating cavity defined by a top plate, a bottom plate and two side plates. The top plate and the bottom plate are respectively provided with multiple accommodating grooves, which include a wider first accommodating groove and a narrower second accommodating groove. Each terminal has an elastic portion accommodated in a corresponding accommodating groove. A first clearance is provided between the elastic portion and a side of the first accommodating groove close to the corresponding side plate. A second clearance is provided between the elastic portion and a side of the second accommodating groove close to the first accommodating groove. The first clearance is greater than the second clearance The shell has a top wall and two side walls. A mating port being defined by the front ends thereof is larger than the mating cavity.

15 Claims, 16 Drawing Sheets

(51) Int. Cl.

| | |
|---|---|
| ***H01R 13/46*** | (2006.01) |
| ***H01R 13/11*** | (2006.01) |
| *H01R 13/6581* | (2011.01) |
| *H01R 13/631* | (2006.01) |
| *H01R 24/60* | (2011.01) |

(52) U.S. Cl.
CPC ..... *H01R 13/115* (2013.01); *H01R 13/46* (2013.01); *H01R 13/631* (2013.01); *H01R 13/6581* (2013.01); *H01R 24/60* (2013.01)

(58) Field of Classification Search
CPC .. H01R 13/631; H01R 13/6581; H01R 24/60; H01R 13/642
USPC ..... 439/474, 246, 677, 660, 678
See application file for complete search history.

(56) References Cited

U.S. PATENT DOCUMENTS

| | | | | |
|---|---|---|---|---|
| 6,334,793 | B1 * | 1/2002 | Amoni | H01R 13/645 439/639 |
| 7,226,314 | B2 * | 6/2007 | Lang | H01R 13/629 439/607.04 |
| 7,704,088 | B2 * | 4/2010 | Sakamoto | H01R 12/57 439/246 |
| 7,748,993 | B2 * | 7/2010 | Midorikawa | H01R 12/716 439/74 |
| 9,742,132 | B1 * | 8/2017 | Hsueh | H01R 24/60 |

* cited by examiner

100

A–A

B–B

ELECTRICAL CONNECTOR PREVENTING A TERMINAL FROM BEING DAMAGED BY EXCESS EXTRUSION

CROSS-REFERENCE TO RELATED PATENT APPLICATION

This application claims priority to and the benefit of, pursuant to 35 U.S.C. § 119(a), patent application Serial No. CN201710728828.2 filed in China on Aug. 23, 2017. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector preventing a terminal from being damaged by excess extrusion.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

During mating of connectors, a better guiding device is not always designed between a receptacle and a plug. Thus, in the mating process, it always takes much time in alignment, and the plug and the receptacle cannot be smoothly mated due to any small-angle offset or misalignment of the plug, which may even cause structure damage on the connectors.

The U.S. Pat. No. 7,226,314 discloses a receptacle connector, which has an insulating body and a guiding shell. The insulating body includes a mating groove defined by a top wall, a bottom wall and two side walls. The mating groove penetrates through a front end surface of the insulating body. The top wall and the bottom wall are provided with a plurality of terminal slots communicated with the mating groove to accommodate a plurality of terminals. The guiding shell is provided with an accommodating space formed by an upper plate and two separating plates, the upper plate bends to the accommodating space to form two elastic arms, and the guiding shell is located at a front end of an opening of the mating groove of the insulating body.

In the patent, the guiding shell is fixed to the front end of the opening of the mating groove of the insulating body. When the receptacle connector is mated with a plug connector, the plug connector can effectively provide quick positioning of the vertical position under the guiding of the elastic arms, so that a tongue plate of the plug connector is accurately inserted into the mating groove, and the plug connector is accommodated in the accommodating space of the guiding shell, thus shortening time wasted by alignment failure during connector mating. However, in the patent, when the tongue plate of the plug connector mates with the receptacle connector, although alignment in the vertical direction can be accurately provided, there is no solution provided for the problem of alignment in a horizontal direction. When the connectors are mated with each other, the tongue plate is prone to a left-right offset due to inaccurate alignment in the horizontal direction, so that the terminals are prone to left-right offset. In particular, the terminals adjacent to the two side walls are offset seriously. That is, the offset of the terminals adjacent to the two side walls is greater than that of the terminals located between the top wall and the bottom wall, so that the terminals adjacent to the two side walls may be damaged due to excess extrusion with the corresponding terminal shells, thereby affecting the service life of the receptacle connector.

Therefore, a heretofore unaddressed need to design a novel electrical connector exists in the art to address the aforementioned deficiencies and inadequacies.

SUMMARY

An objective of the present invention is to provide an electrical connector preventing the terminals from being damaged by excess extrusion.

To achieve the foregoing objective, the present invention adopts the following technical solutions.

An electrical connector, configured to be electrically connected to a mating plug, includes: a body, including a mating cavity defined by a top plate, a bottom plate and two side plates, the mating cavity allowing insertion of an insertion portion of the mating plug, wherein the top plate and the bottom plate are respectively provided with a plurality of accommodating grooves communicated with the mating cavity, the accommodating grooves include a first accommodating groove and a second accommodating groove, the first accommodating groove is located at an outer side of the second accommodating groove and adjacent to a corresponding one of the side plates, and a width of the first accommodating groove is greater than a width of the second accommodating groove; a plurality of terminals, each having an elastic portion accommodated in the corresponding accommodating groove, the elastic portion protruding into the mating cavity and configured to mate with the insertion portion, wherein a first clearance is provided between the elastic portion accommodated in the first accommodating groove and a side of the first accommodating groove close to the corresponding side plate, a second clearance is provided between the elastic portion accommodated in the second accommodating groove and a side of the second accommodating groove close to the first accommodating groove, and the first clearance is greater than the second clearance; and a shell, having a top wall and two side walls bending and extending downward from two opposite sides of the top wall, wherein a mating port is defined by front ends of the top wall and the two side walls, the mating port is larger than the mating cavity, the top wall shields the top plate and protrudes forward beyond the top plate, and each of the side walls shields the corresponding side plate and protrudes forward beyond the side plate.

In certain embodiments, at least two first accommodating grooves are located on a same side of the second accommodating groove, a first partition is provided between two adjacent ones of the first accommodating grooves, a second partition is provided between the first accommodating grooves and the second accommodating groove, and a width of the first partition is smaller than a width of the second partition.

In certain embodiments, the terminals are of a same structure, and distances between each two adjacent ones of the terminals are equal.

In certain embodiments, a third clearance is provided between the elastic portion accommodated in the first accommodating groove and a side of the first accommodating groove away from the corresponding side plate, and the third clearance is equal to the second clearance.

In certain embodiments, a partition is provided between two adjacent ones of the accommodating grooves, a plurality of ribs respectively protrudes from the partitions into the mating cavity, and a front end of the body has a guide chamfer extending from an opening of the mating cavity to front ends of the ribs.

In certain embodiments, the body has a connecting portion connecting the front ends of at least two ribs, a height of the connecting portion is same as heights of the ribs, and the guide chamfer extends to a front end of the connecting portion.

In certain embodiments, at least one of the ribs is located between two adjacent ones of second accommodating grooves, and a side surface of each of the ribs is flush with a corresponding side surface of the second accommodating groove vertically.

In certain embodiments, at least one of the ribs is located between the first accommodating groove and the second accommodating groove, one side surface of each of the ribs is flush with a corresponding side surface of the second accommodating groove vertically, and the other side face of each of the ribs is staggered with a corresponding side surface of the first accommodating groove vertically.

In certain embodiments, the elastic portion is provided with two chamfers respectively at two opposite sides thereof, each of the chamfers extends to a free end of the elastic portion, a front end of each of the accommodating grooves has a front wall surface, and the free end of the elastic portion is accommodated in the corresponding accommodating groove and shielded by the front wall surface.

Compared with the prior art, the electrical connector of certain embodiments of the present invention has the following beneficial effects.

The first accommodating groove is adjacent to the corresponding side plate. A first clearance is provided between the elastic portion accommodated in the first accommodating groove and a side of the first accommodating groove close to the corresponding side plate, a second clearance is provided between the elastic portion accommodated in the second accommodating groove and a side of the second accommodating groove close to the first accommodating groove, and the first clearance is greater than the second clearance. By increasing the first clearance, when the insertion portion is inserted into the mating cavity obliquely, the elastic portion is deformed in the first clearance, thus preventing the terminals from being damaged due to excess extrusion between the elastic portion and the side of the first accommodating groove close to the corresponding side plate, and thereby ensuring the service life of the electrical connector.

To achieve the foregoing objective, the present invention may also adopt the following technical solutions.

An electrical connector, configured to be electrically connected to a mating plug, includes: a body, comprising a mating cavity defined by a top plate, a bottom plate and two side plates, the mating cavity allowing insertion of an insertion portion of the mating plug, wherein the top plate and the bottom plate are located at upper and lower sides of the mating cavity, the two side plates are located at left and right sides of the mating cavity, the mating cavity has a center line, the top plate and the bottom plate are provided with a plurality of first accommodating groves, at least one of the first accommodating grooves is respectively disposed at a left side and a right side of the center line, the first accommodating grooves are communicated with the mating cavity and adjacent to the corresponding side plate, and each of the first accommodating grooves has a left wall surface and a right wall surface disposed oppositely in a left-right direction; a plurality of terminals, correspondingly accommodated in the first accommodating grooves, each of the terminals having an elastic portion accommodated in the corresponding first accommodating groove, the elastic portion protruding into the mating cavity and mating with the insertion portion, wherein at the left side of the center line, a clearance between the elastic portion and the left wall surface is greater than a clearance between the elastic portion and the right wall surface, and at the right side of the center line, a clearance between the elastic portion and the left wall surface is smaller than a clearance between the elastic portion and the right wall surface; and a shell, having a top wall and two side walls bending and extending downward from two opposite sides of the top wall, wherein a mating port is defined by front ends of the top wall and the two side walls, the mating port is larger than the mating cavity, the top wall shields the top plate and protrudes forward beyond the top plate, and each of the side walls shields the corresponding side plate and protrudes forward beyond the side plate.

In certain embodiments, each of the top plate and the bottom plate are further provided with at least one second accommodating groove respectively, the first accommodating grooves are located on left and right sides of the at least one second accommodating groove, a width of each of the first accommodating grooves is greater than a width of each of the at least one second accommodating groove, a first partition is provided between two of the first accommodating grooves, a second partition is provided between the first accommodating grooves and the at least one second accommodating groove, and a width of the first partition is smaller than a width of the second partition.

In certain embodiments, the first accommodating grooves are bilaterally symmetric along the center line, the terminals are of a same structure, and distances between each two adjacent ones of the terminals are equal.

In certain embodiments, a partition is provided between two adjacent ones of the first accommodating grooves, a plurality of ribs respectively protrudes from the partitions into the mating cavity, and a front end of the body has a guide chamfer extending from an opening of the mating cavity to front ends of the ribs.

In certain embodiments, the body has a connecting portion connecting the front ends of at least two ribs, a height of the connecting portion is same as heights of the ribs, and the guide chamfer extends to a front end of the connecting portion.

In certain embodiments, a side surface of at least one of the ribs is staggered with a side surface of the corresponding first accommodating groove vertically.

In certain embodiments, the elastic portion is provided with two chamfers respectively at two opposite sides thereof, each of the chamfers extends to a free end of the elastic portion, a front end of each of the accommodating grooves has a front wall surface, and the free end of the elastic portion is accommodated in the corresponding accommodating groove and shielded by the front wall surface.

Compared with the related art, the electrical connector according to certain embodiments of the present invention also has the following beneficial effects.

At the left side of the center line, a clearance between the elastic portion and the left wall surface is greater than a clearance between the elastic portion and the right wall surface, and at the right side of the center line, a clearance between the elastic portion and the left wall surface is smaller than a clearance between the elastic portion and the right wall surface. When the insertion portion is inserted into the mating cavity obliquely, the terminals can be prevented from being damaged due to excess extrusion between the elastic portion and the side of the first accommodating groove close to the corresponding side plate, thereby ensuring the service life of the electrical connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
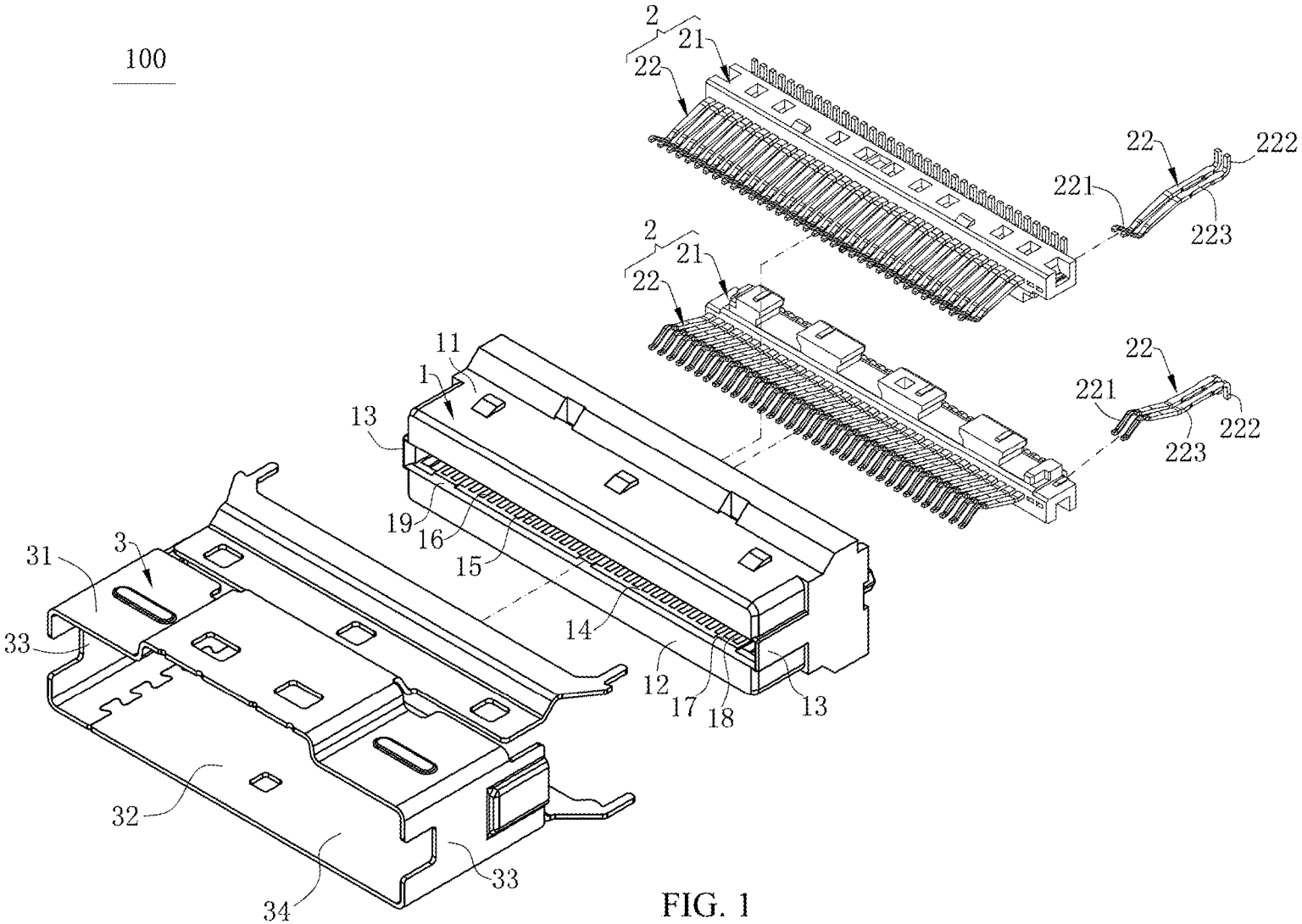
FIG. 1 is a perspective view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-16. In accordance with the purposes of this invention, as embodied and broadly described herein, this invention, in one aspect, relates to an electrical connector.

As shown in FIG. 1 to FIG. 11, an electrical connector 100 in a first embodiment of the present invention is used for being electrically connected to a mating plug 200, and includes a body 1, two terminal modules 2 installed in the body 1, and a shell 3 covering the body 1.

As shown in FIG. 1, the body 1 is made of an insulating material, and includes a mating cavity 14 defined by a top plate 11, a bottom plate 12 and two side plates 13. The mating cavity 14 allows insertion of an insertion portion 4 of the mating plug 200. The top plate 11 and the bottom plate 12 are located on the upper and lower sides of the mating cavity 14, and the two side plates 13 are located on the left and right sides of the mating cavity 14.

The top plate 11 and the bottom plate 12 are respectively provided with a plurality of accommodating grooves 15 communicated with the mating cavity 14. The accommodating grooves 15 are symmetrically disposed in an upper row and a lower row (also referring to FIG. 10). A front end of each accommodating groove 15 has a front wall surface 153, and each accommodating groove 15 is protrudingly provided with a stopping block 154 (also referring to FIG. 5).

Figure 8:
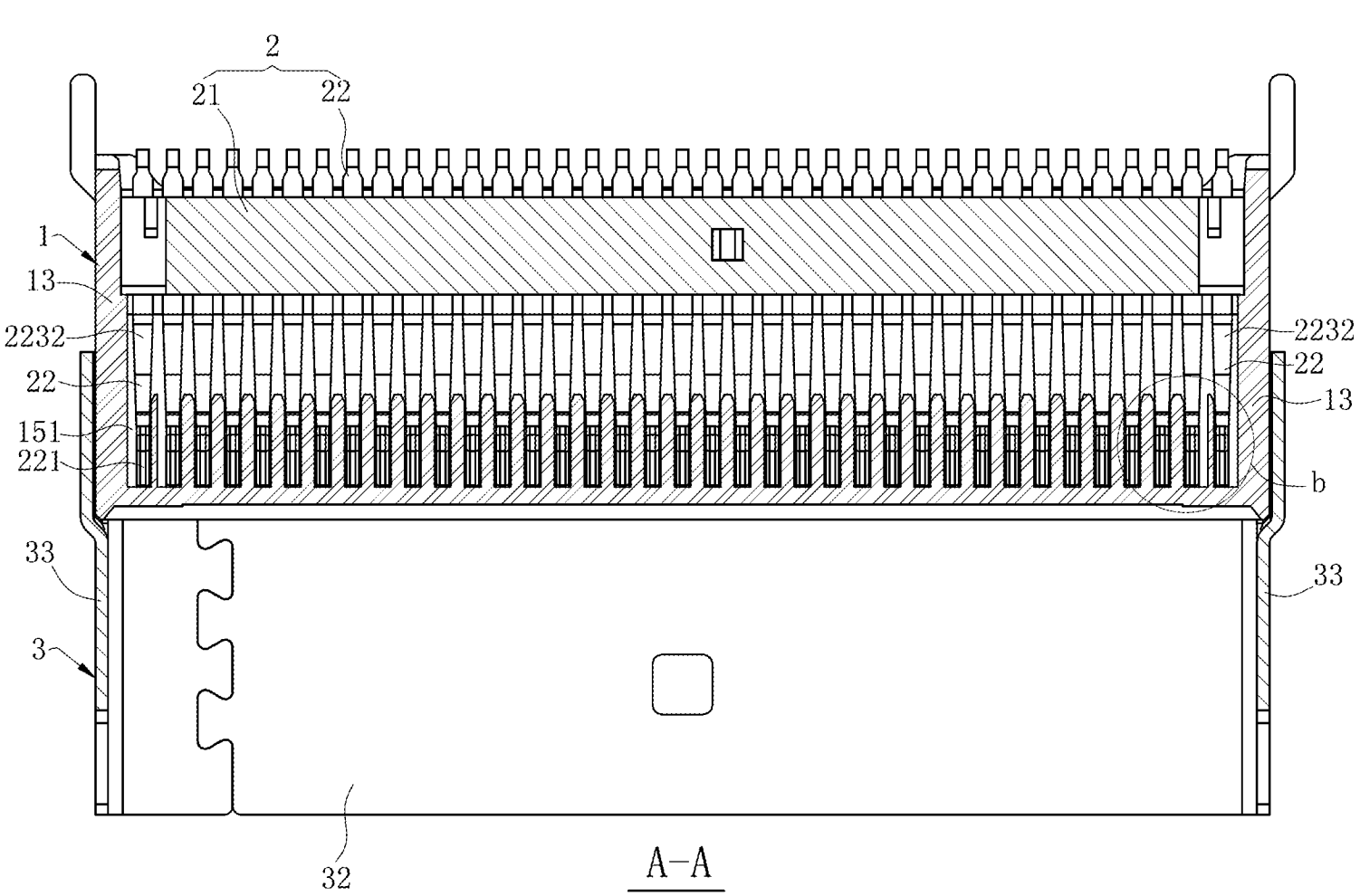
FIG. 8 is a sectional view of FIG. 6 along an A-A direction.
Figure 9:
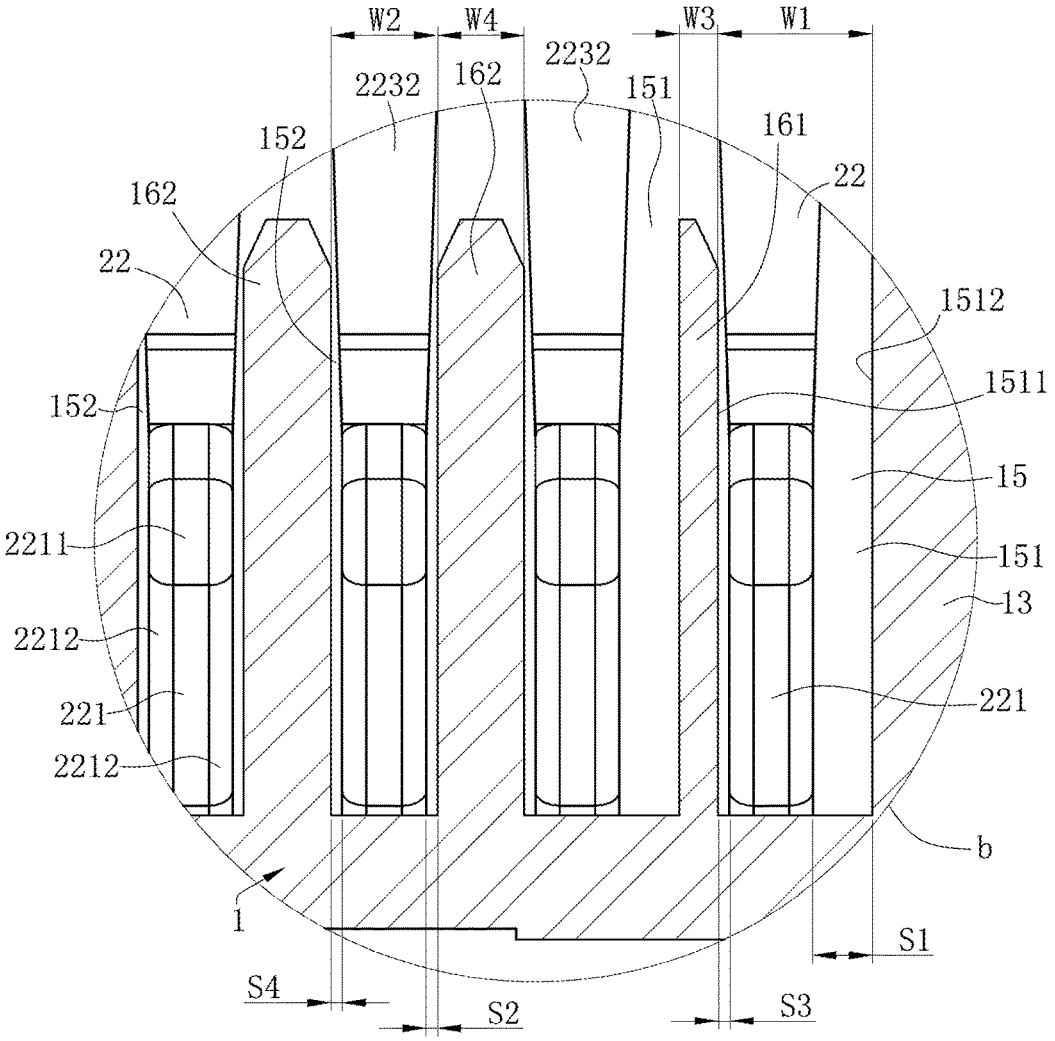
FIG. 9 is an enlarged view of a part b in FIG. 8.

As shown in FIG. 8 and FIG. 9, the accommodating grooves 15 in each row include a plurality of second accommodating grooves 152 successively distributed in the middle, and a plurality of first accommodating grooves 151 that are located on the left and right sides of the second accommodating grooves 152 and adjacent to the corresponding side plates 13. A width W1 of each of the first accommodating grooves 151 is greater than a width W2 of each of the second accommodating grooves 152.

A partition 16 is provided between each of two adjacent accommodating grooves 15. The partitions 16 includes a plurality of first partitions 161 located between two adjacent first accommodating grooves 151, and a plurality of second partitions 162 located between the first accommodating grooves 151 and the second accommodating grooves 152 or located between two adjacent second accommodating grooves 152. A width W3 of each of the first partitions 161 is smaller than a width W4 of each of the second partitions 162.

Figure 3:
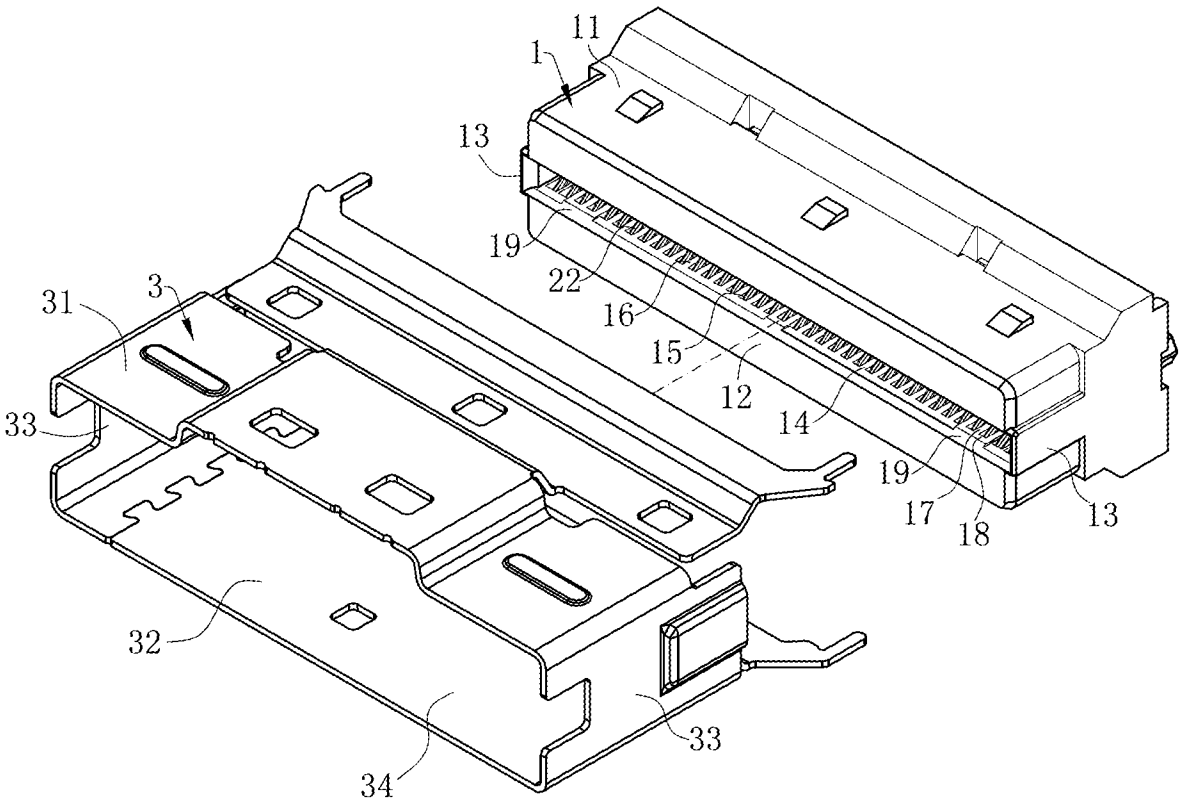
FIG. 3 is a perspective view of a terminal in FIG. 1 after being assembled to a body.
Figure 4:
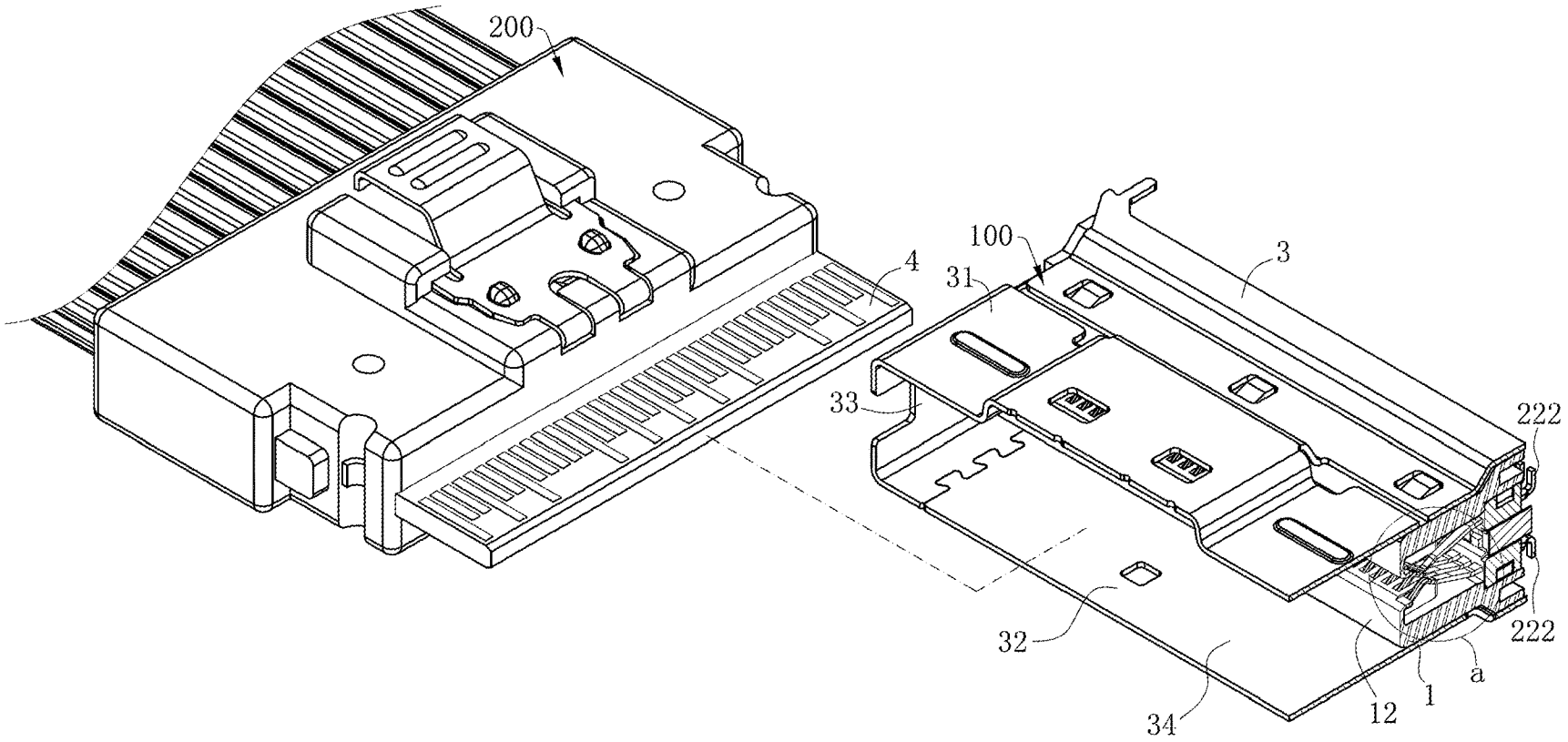
FIG. 4 is a perspective view of an electrical connector in FIG. 3 before mating with a mating plug.
Figure 5:
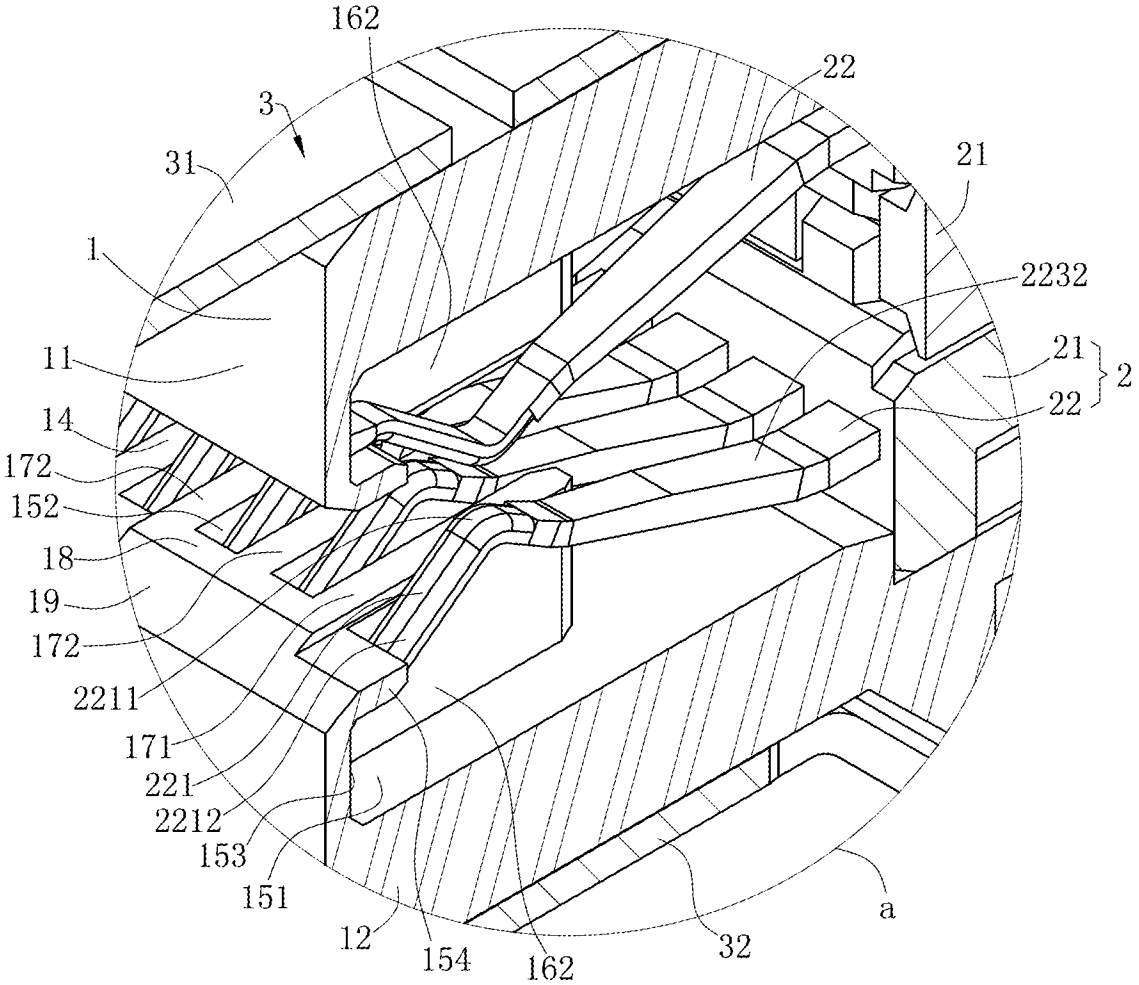
FIG. 5 is an enlarged view of a part a in FIG. 4.

As shown in FIG. 3, FIG. 4 and FIG. 5, a plurality of ribs 17 respectively protrudes from the plurality of partitions 16 into the mating cavity 14, and a front end of the body 1 has a guide chamfer 19 extending from an opening of the mating cavity 14 to front ends of the ribs 17.

Figure 10:
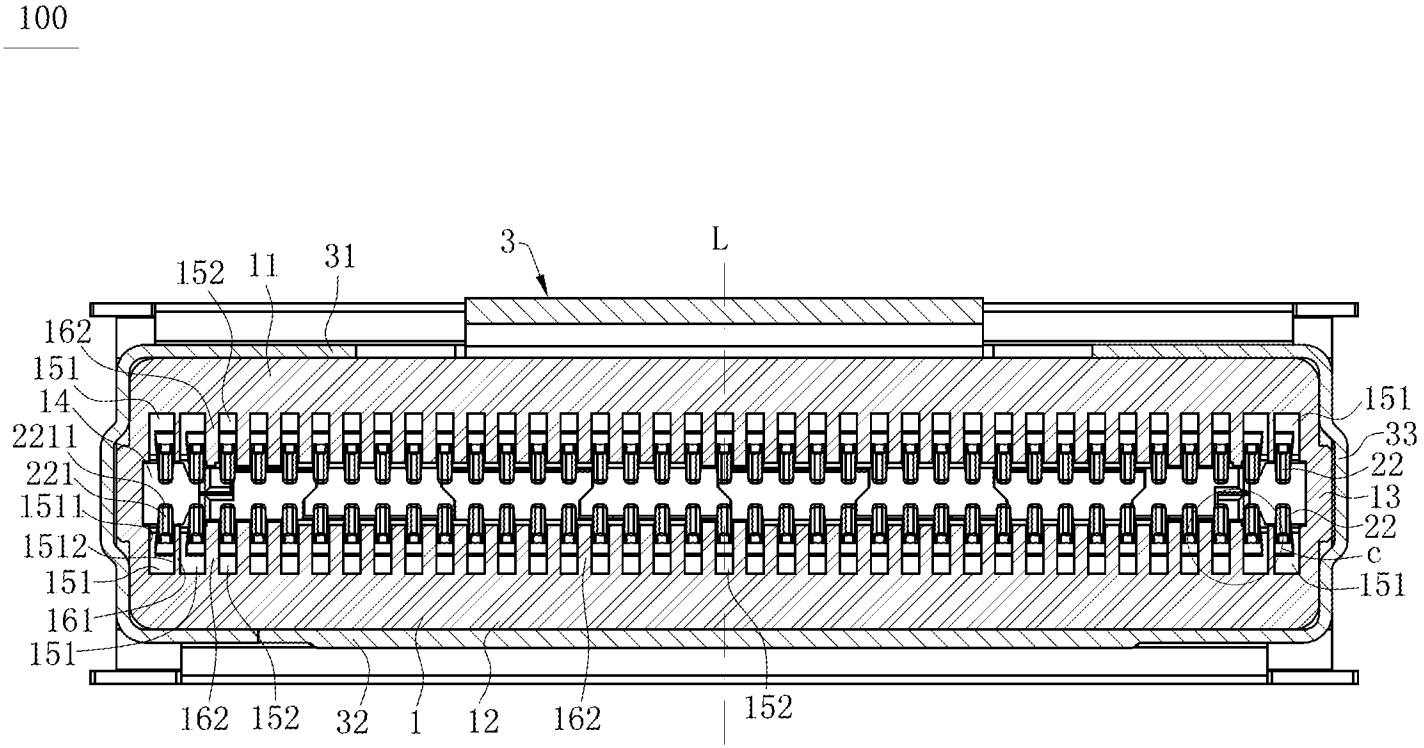
FIG. 10 is a sectional view of FIG. 6 along a B-B direction.
Figure 11:
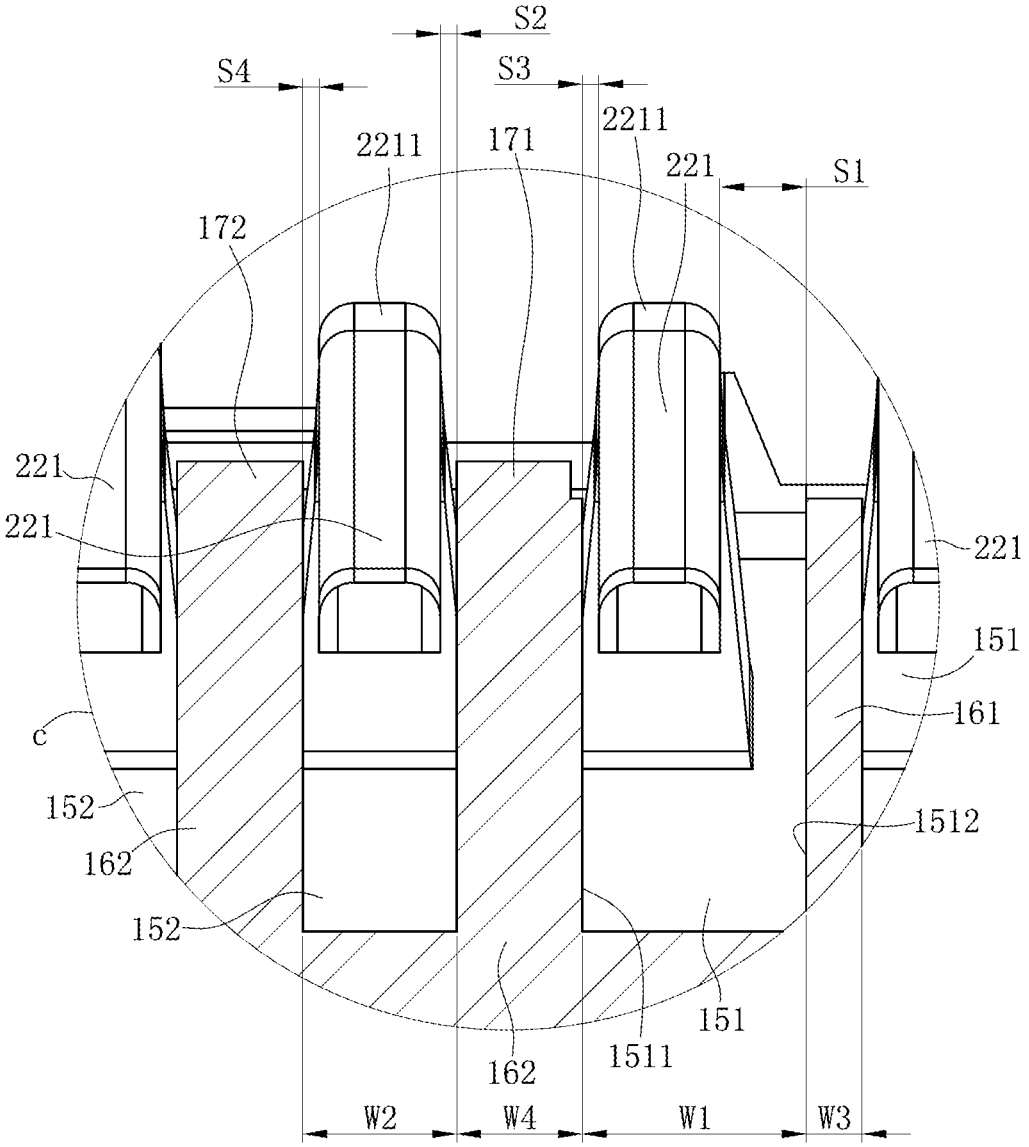
FIG. 11 is an enlarged view of a part c in FIG. 10.
Figure 12:
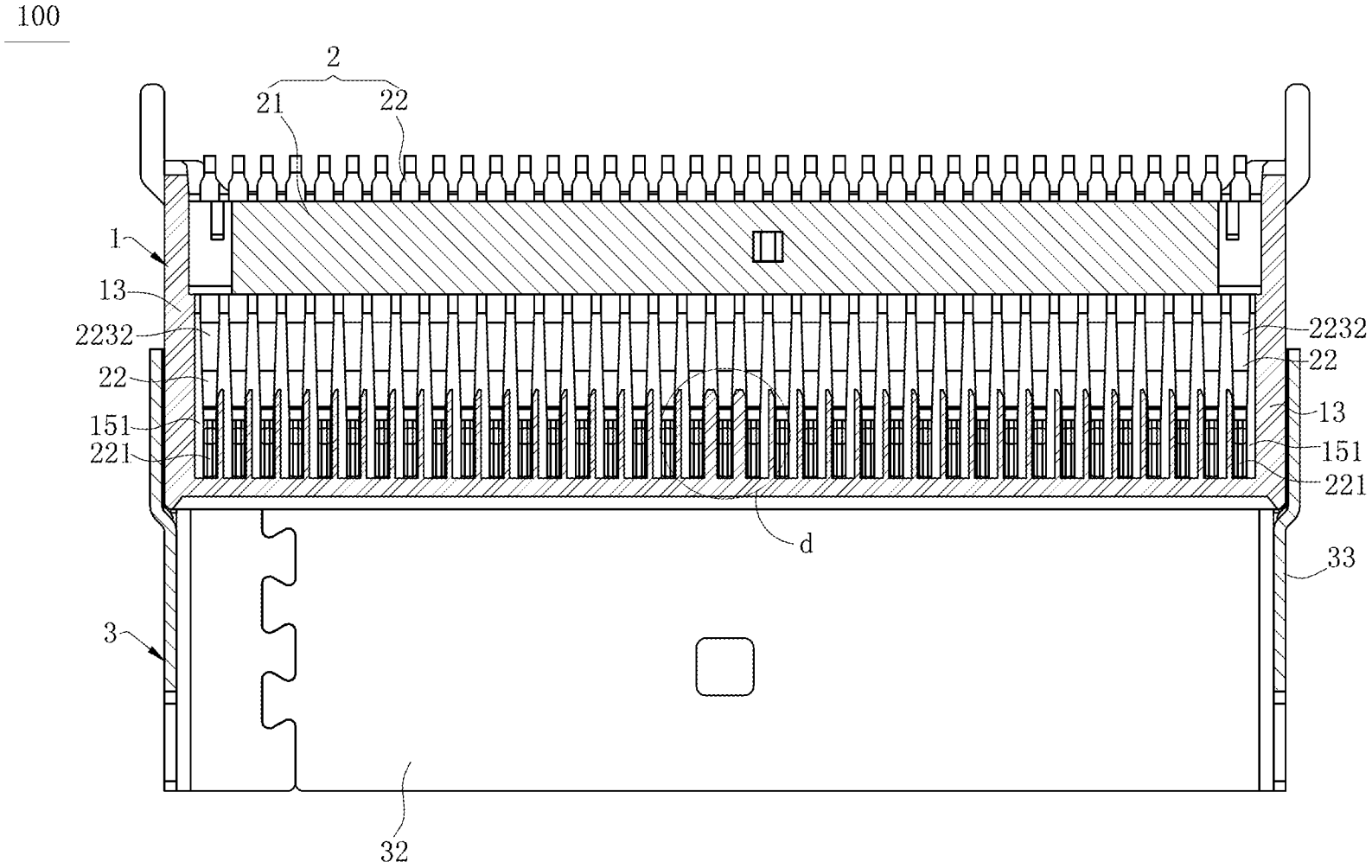
FIG. 12 is a sectional view of an electrical connector according to a second embodiment of the present invention.
Figure 13:
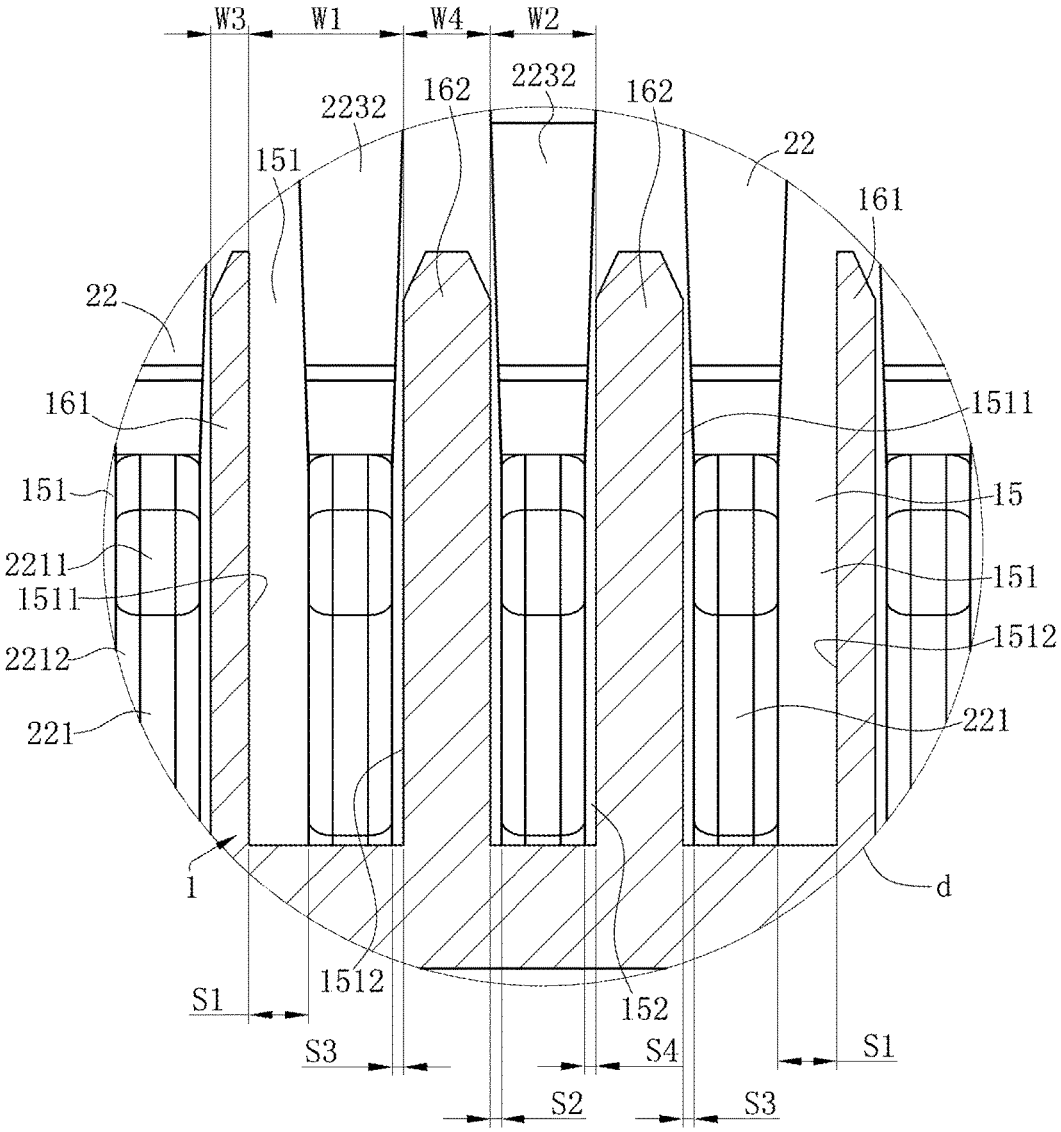
FIG. 13 is an enlarged view of a part d in FIG. 12.
Figure 14:
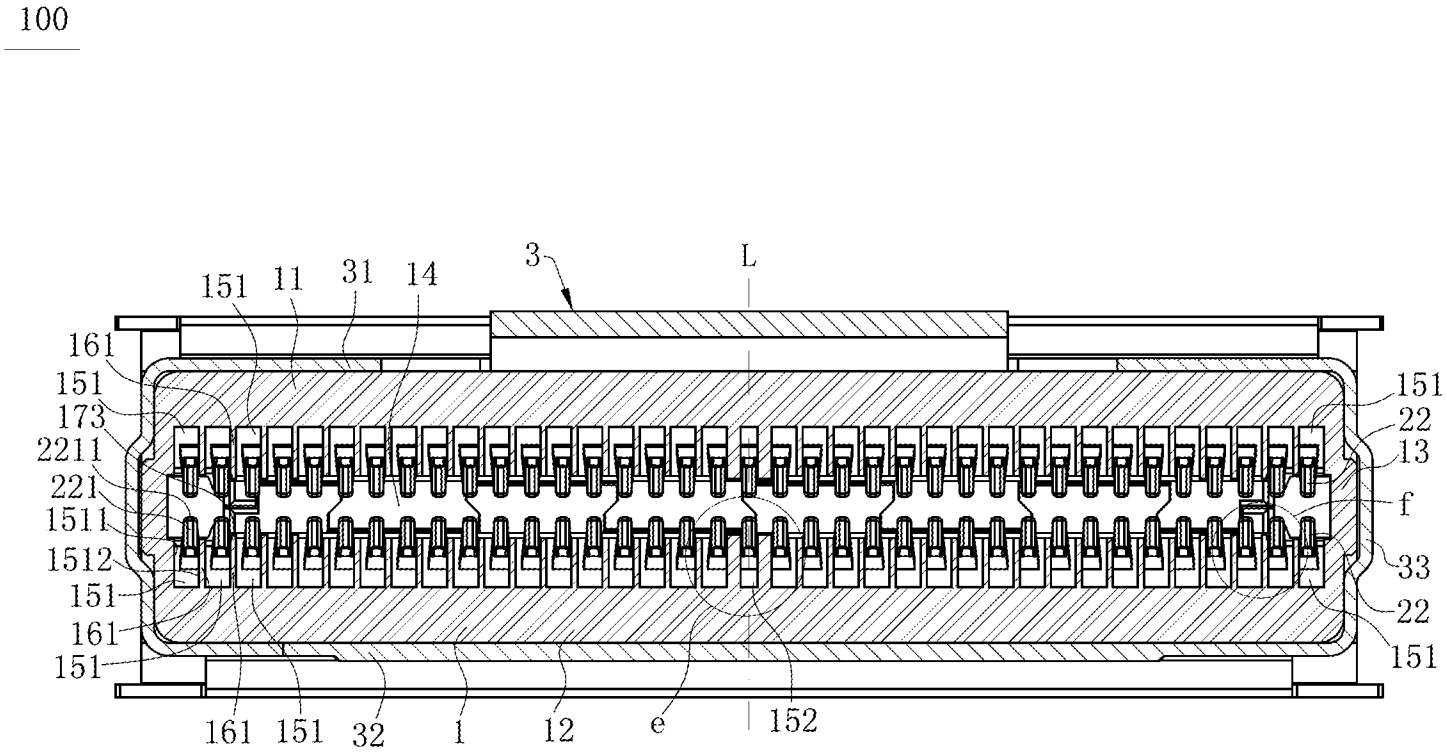
FIG. 14 is a sectional view of an electrical connector from another viewing angle according to the second embodiment of the present invention.
Figure 15:
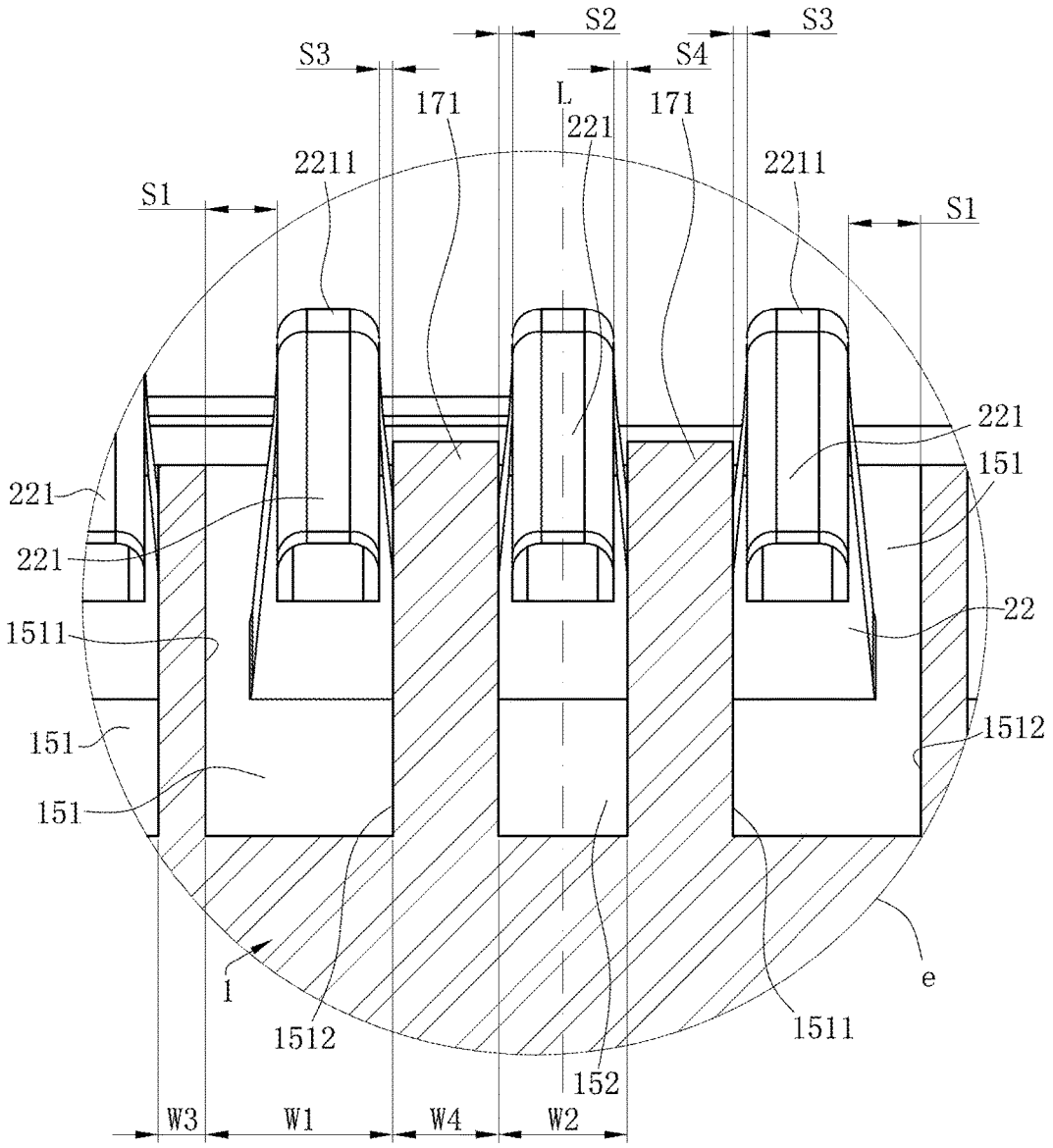
FIG. 15 is an enlarged view of a part e in FIG. 14.
Figure 16:
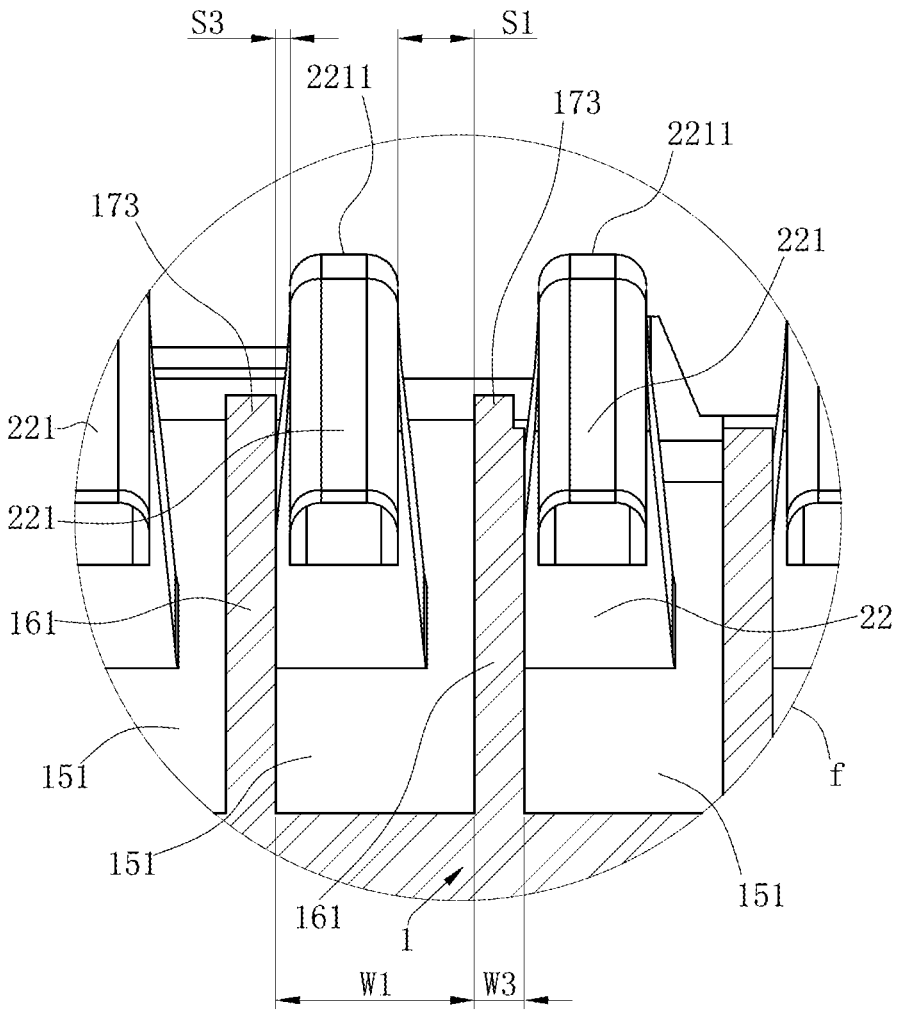
FIG. 16 is an enlarged view of a part fin FIG. 14.

As shown in FIG. 10 and FIG. 11, the ribs 17 include a plurality of first ribs 171 (or, in other embodiments, only one first rib 171 may be provided) located between the first accommodating grooves 151 and the second accommodating grooves 152, and a plurality of second ribs 172 (or, in other embodiments, only one second rib 172 may be provided) located between two adjacent second accommodating grooves 152.

One side surface of each of the first ribs 171 is flush with the corresponding side face of the second accommodating groove 152 vertically, and the other side surface of each of the first ribs 171 is staggered with the corresponding side surface of the first accommodating groove 151 vertically.

One side surface of each of the second ribs 172 is flush with the corresponding side surface of the second accommodating groove 152 vertically. That is, the side surface of each of the second ribs 172 is also flush with the corresponding side surface of the second accommodating groove 152 vertically.

As shown in FIG. 3, FIG. 4 and FIG. 5, the body 1 has a connecting portion 18 connecting the front ends of at least two ribs 17. In the present embodiment, the connecting portion 18 may be connected to the front ends of two ribs 17, or may be connected to the front ends of three ribs 17. In other embodiments, the connecting portion 18 may also be connected to the front ends of more than three ribs 17. A height of the connecting portion 18 is the same as heights of the ribs 17, and the guide chamfer 19 extends to a front end of the connecting portion 18.

Figure 2:
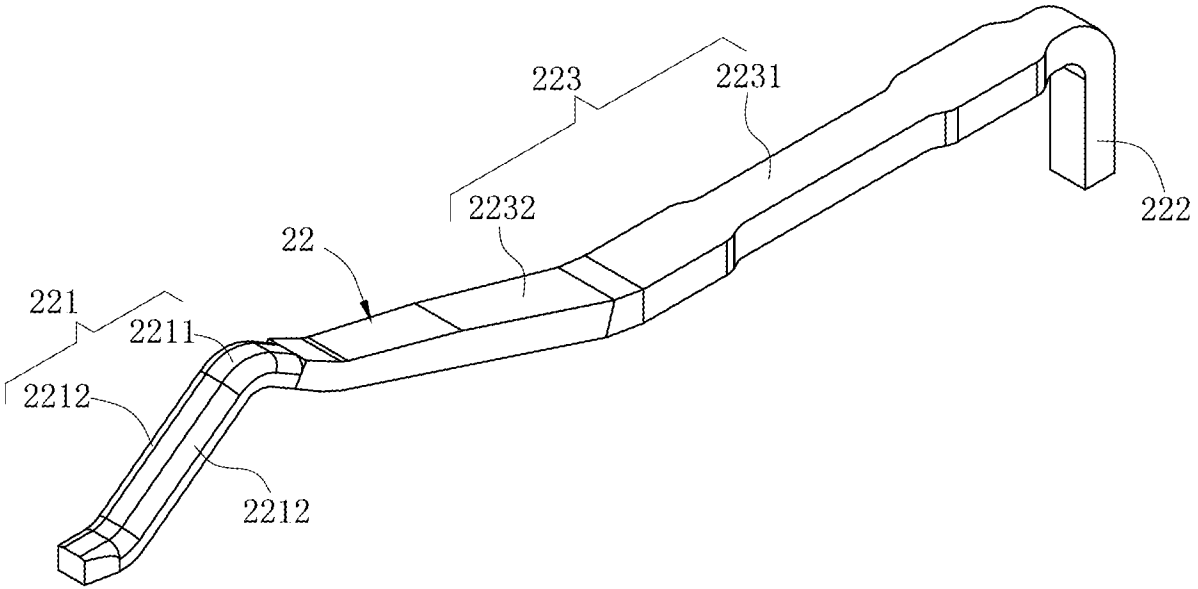
FIG. 2 is a perspective view of a terminal in FIG. 1.

As shown in FIG. 1 and FIG. 2, each terminal module 2 includes an insulating block 21, and a row of terminals 22 insert-molded with the insulating block 21. The terminals 22 are of the same structure, and are correspondingly accommodated in the accommodating grooves 15. Distances between each two adjacent terminals 22 are equal (also referring to FIG. 10).

Each terminal 22 includes an elastic portion 221, a tail portion 222, and a main body portion 223 connecting the elastic portion 221 and the tail portion 222.

The elastic portion 221 is accommodated in the accommodating groove 15. The stopping block 154 stops the elastic portion 221 from moving toward the mating cavity 14 (also referring to FIG. 5 and FIG. 6). The elastic portion 221 has a contact portion 2211 protruding into the mating cavity 14 and used to mate with the insertion portion 4. Each of two opposite sides of the elastic portion 221 is provided with a chamfer 2212. Each of the chamfers 2212 extends to a free end of the elastic portion 221 from the contact portion 2211. The chamfer 2212 provide a guiding function, which can effectively avoid damage to the terminals 22 due to oblique insertion of the insertion portion 4, and the free end of the elastic portion 221 is accommodated in the accommodating groove 15 and shielded by the front wall surface 153 (also referring to FIG. 5 and FIG. 6).

The tail portion 222 extends beyond the body 1, and uses the surface mounting technology to mount to a circuit board (not shown in the figures).

The main body portion 223 has a fixing portion 2231 fixed to the insulating block 21, and an extending portion 2232 connecting the fixing portion 2231 and the elastic portion 221. The extending portion 2232 is located behind the accommodating groove 15 and is not accommodated in the accommodating groove 15 (also referring to FIG. 8).

As shown in FIG. 9 and FIG. 11, a first clearance S1 is provided between the elastic portion 221 accommodated in the first accommodating groove 151 and a side of the first accommodating groove 151 close to the corresponding side plate 13, and a second clearance S2 is provided between the elastic portion 221 accommodated in the second accommodating groove 152 and a side of the second accommodating groove 152 close to the first accommodating groove 151. The first clearance S1 is greater than the second clearance S2.

A third clearance S3 is provided between the elastic portion 221 accommodated in the first accommodating groove 151 and a side of the first accommodating groove 151 away from the corresponding side plate 13, and a fourth clearance S4 is provided between the elastic portion 221 accommodated in the second accommodating groove 152 and a side of the second accommodating groove 152 away from the first accommodating groove 151. The second clearance S2, the third clearance S3 and the fourth clearance S4 are equal.

As shown in FIG. 10 and FIG. 11, the mating cavity 14 has a center line L. The first accommodating grooves 151 are symmetrically disposed on the left and right sides of the center line L, and each first accommodating groove 151 has a left wall surface 1511 and a right wall surface 1512 disposed oppositely in a left-right direction.

At the left side of the center line L, a clearance (i.e., the first clearance S1) between the elastic portion 221 accommodated in the first accommodating groove 151 and the left wall surface 1511 is greater than a clearance (i.e., the third clearance S3) between the elastic portion 221 accommodated in the first accommodating groove 151 and the right wall surface 1512.

At the right side of the center line L, a clearance (i.e., the third clearance S3) between the elastic portion 221 accommodated in the first accommodating groove 151 and the left wall surface 1511 is smaller than a clearance (i.e., first clearance S1) between the elastic portion 221 accommodated in the first accommodating groove 151 and the right wall surface 1512.

As shown in FIG. 3 and FIG. 4, the shell 3 is made of a metal material, and has a top wall 31, a bottom wall 32 and two side walls 33. The top wall 31 shields the top plate 11 and protrudes forward beyond the top plate 11. The bottom wall 32 shields the bottom plate 12 and protrudes forward beyond the bottom plate 12. Each side wall 33 shields the corresponding side plate 13 and protrudes forward beyond the side plate 13.

Figure 6:
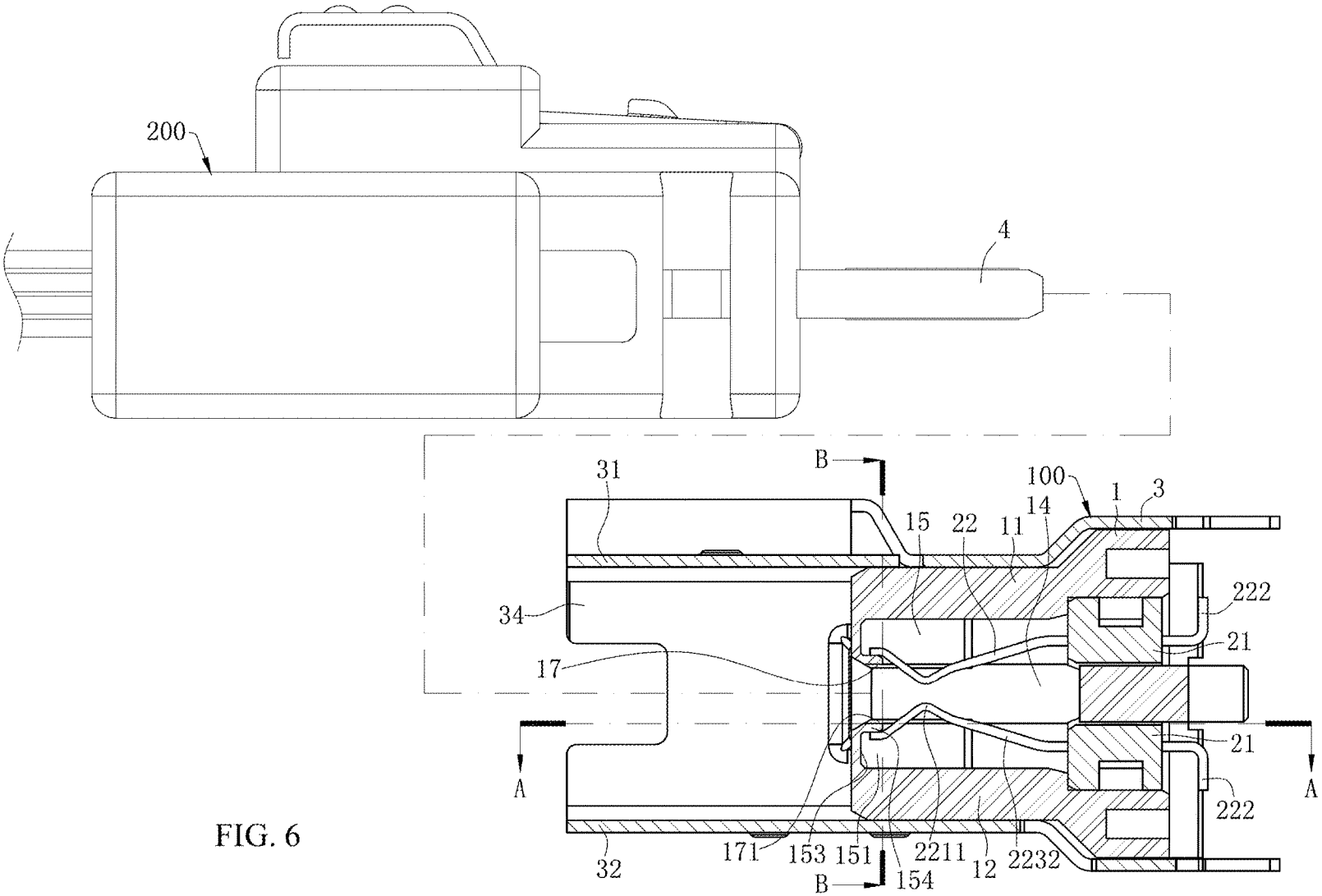
FIG. 6 is a plain view of an electrical connector in FIG. 4 before mating with a mating plug.
Figure 7:
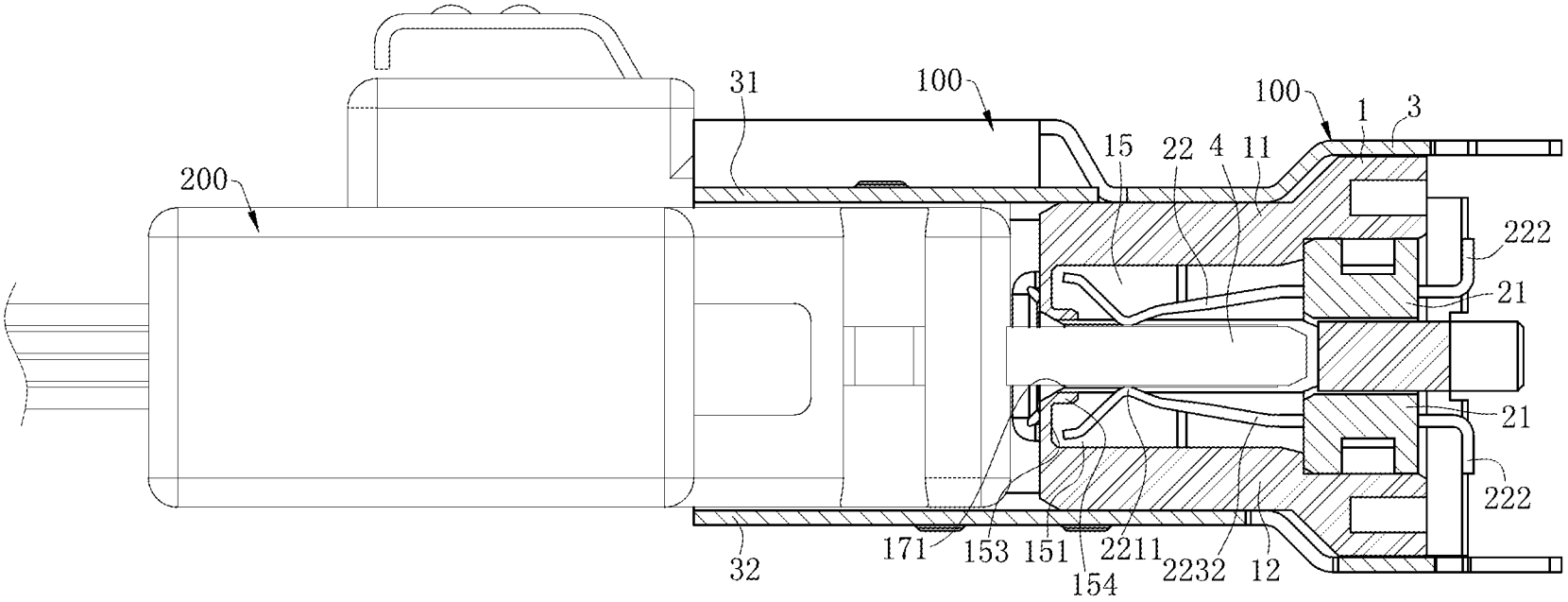
FIG. 7 is a plain view of an electrical connector in FIG. 4 after mating with a mating plug.

As shown in FIG. 4 and FIG. 6, the front end of the shell 3 has a mating port 34 located in front of the mating cavity 14. A width of the mating port 34 is greater than that of the mating cavity 14, and a height of the mating port 34 is greater than that of the mating cavity 14. Thus, when the insertion portion 4 is inserted into the mating port 34, a clearance is provided between the insertion portion 4 and the mating portion 34, thereby causing that the insertion portion 4 is prone to oblique insertion into the mating cavity 14 due to misalignment. In this case, the offset of the terminals 22 adjacent to the two side plates 13 in each row of terminals 22 is greater than that of the terminals 22 adjacent to the center line L. In the present embodiment, by increasing the first clearance S1 (also referring to FIG. 9 and FIG. 11), the elastic portion 221 can be deformed in the first clearance S1, thus preventing the terminals 22 from being damaged due to excess extrusion between the elastic portion 221 and the side of the first accommodating groove 151 close to the corresponding side plate 13, thereby ensuring the service life of the electrical connector 100.

FIG. 12 to FIG. 16 show an electrical connector 100 in a second embodiment of the present invention. The difference of this embodiment from the first embodiment exists in that, in the present embodiment, each row of the accommodating grooves 15 only includes one second accommodating groove 152, and a plurality of first accommodating grooves 151 are successively disposed at the left and right sides of the second accommodating groove 152. Further, the ribs 17 do not include the second ribs 172, but further include a plurality of third ribs 173 located between two adjacent first accommodating grooves 151, where the side surfaces of the third ribs 173 adjacent to the side plates 13 are staggered with the corresponding side surfaces of the first accommodating grooves 151 vertically.

In other embodiments, the first clearance S1 may be gradually increased from the center line L to the two side walls 33, and the objectives of the present invention can be still achieved when the first clearance S1 is greater than the third clearance S3.

To sum up, the electrical connector of certain embodiments of the present invention has the following beneficial effects.

(1) The first accommodating grooves 151 are adjacent to the corresponding side plate 13. A first clearance S1 is provided between the elastic portion 221 accommodated in the first accommodating groove 151 and a side of the first accommodating groove 151 close to the corresponding side plate 13, and a second clearance S2 is provided between the elastic portion 221 accommodated in the second accommodating groove 152 and a side of the second accommodating groove 152 close to the first accommodating groove 151. The first clearance S1 is greater than the second clearance S2. By increasing the first clearance S1, when the insertion portion 4 is inserted into the mating cavity 14 obliquely, the elastic portion 221 is deformed in the first clearance S1, thus preventing the terminals 22 from being damaged due to excess extrusion between the elastic portion 221 and the side of the first accommodating groove 151 close to the corresponding side plate 13, thereby ensuring the service life of the electrical connector 100.

(2) The first accommodating grooves 151 are adjacent to the corresponding side plate 13. At the left side of the center line L, a clearance between the elastic portion 221 and the left wall surface 1511 is greater than a clearance between the elastic portion 221 and the right wall surface 1512. At the right side of the center line L, a clearance between the elastic portion 221 and the left wall surface 1511 is smaller than a clearance between the elastic portion 221 and the right wall surface 1512. When the insertion portion 4 is inserted into the mating cavity 14 obliquely, the terminals 22 can be prevented from being damaged due to excess extrusion between the elastic portion 221 and the side of the first accommodating groove 151 close to the corresponding side plate 13, thereby ensuring the service life of the electrical connector 100.

(3) The width of the first partition 161 is smaller than that of the second partition 162. By reducing the width of the first partition 161, the first clearance S1 is correspondingly increased, thus preventing the terminals 22 from being damaged due to excess extrusion.

(4) A plurality of ribs 17 protrudes respectively from the plurality of partitions 16 into the mating cavity 14. The ribs 17 can strengthen the combination force between the mating cavity 14 and the insertion portion 4, thereby reducing a space for movement during vibration of the insertion portion 4, and preventing an unstable electrical connection between the terminals 22 and the insertion portion 4 during the vibration. The front end of the body 1 has a guide chamfer 19 extending from an opening of the mating cavity 14 to front ends of the ribs 17, and the insertion portion 4 can be directly guided and inserted into the mating cavity 14, thereby reducing the wearing of the front ends of the ribs 17 caused by the insertion portion 4, and reducing the difficulty in mating of the electrical connector 100 and the mating plug 200.

(5) The body 1 has a connecting portion 18 connecting the front ends of at least two ribs 17. A height of the connecting portion 18 is the same as heights of the ribs 17, and the guide chamfer 19 extends to a front end of the connecting portion 18, so as to increase the strength of the front ends of the ribs 17, thereby improving the wear resistance of the ribs 17.

(6) The side surface of each of the second ribs 172 is flush with the corresponding side surface of the second accommodating groove 152 vertically, thereby increasing the strength of the second rib 172, and avoiding the phenomenon of short shots of the second rib 172 easily caused in a molding process.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to be electrically connected to a mating plug, comprising:

a body, comprising a mating cavity defined by a top plate, a bottom plate and two side plates, the mating cavity allowing insertion of an insertion portion of the mating plug, wherein the top plate and the bottom plate are respectively provided with a plurality of accommodating grooves communicated with the mating cavity, the accommodating grooves comprise a first accommodating groove and a second accommodating groove, the first accommodating groove is located at an outer side of the second accommodating groove and adjacent to a corresponding one of the side plates, and a width of the first accommodating groove is greater than a width of the second accommodating groove;

a plurality of terminals, each having an elastic portion accommodated in a corresponding one of the accommodating grooves, the elastic portion protruding into the mating cavity and configured to mate with the insertion portion, wherein a first clearance is provided between the elastic portion accommodated in the first accommodating groove and a side of the first accommodating groove close to the corresponding side plate, a second clearance is provided between the elastic portion accommodated in the second accommodating groove and a side of the second accommodating groove close to the first accommodating groove, and the first clearance is greater than the second clearance; and a shell, having a top wall and two side walls bending and extending downward from two opposite sides of the top wall, wherein a mating port is defined by front ends of the top wall and the two side walls, the mating port is larger than the mating cavity, the top wall shields the top plate and protrudes forward beyond the top plate, and each of the side walls shields the corresponding side plate and protrudes forward beyond the side plate, wherein at least two first accommodating grooves are located on a same side of the second accommodating groove, a first partition is provided between two adjacent ones of the first accommodating grooves, a second partition is provided between the first accommodating grooves and the second accommodating groove, and a width of the first partition is smaller than a width of the second partition.

2. The electrical connector of claim 1, wherein the terminals are of a same structure, and distances between each two adjacent ones of the terminals are equal.

3. The electrical connector of claim 1, wherein a third clearance is provided between the elastic portion accommodated in the first accommodating groove and a side of the first accommodating groove away from the corresponding side plate, and the third clearance is equal to the second clearance.

4. The electrical connector of claim 1, wherein the elastic portion is provided with two chamfers respectively at two opposite sides thereof, each of the chamfers extends to a free end of the elastic portion, a front end of each of the accommodating grooves has a front wall surface, and the free end of the elastic portion is accommodated in the corresponding one of the accommodating grooves and shielded by the front wall surface.

5. The electrical connector of claim 1, wherein a first rib protrudes from the second partition into the mating cavity, and a front end of the body has a guide chamfer extending from an opening of the mating cavity to a front end of the first rib.

6. The electrical connector of claim 5, wherein the accommodating grooves comprise a plurality of second accommodating grooves, a second rib is located between two adjacent ones of the second accommodating grooves, the body has a connecting portion connecting the front end of the first rib and a front end of the second rib, a height of the connecting portion, a height of the first rib and a height of the second rib are identical, and the guide chamfer extends to a front end of the connecting portion.

7. The electrical connector of claim 5, wherein the accommodating grooves comprise a plurality of second accommodating grooves, a second rib is located between two adjacent ones of the second accommodating grooves and protrudes into the mating cavity, and a side surface of the second rib is flush with a side surface of a corresponding one of the second accommodating grooves vertically.

8. The electrical connector of claim 5, wherein one side surface of the first rib is flush with a corresponding side surface of the second accommodating groove vertically, and the other side face of the first rib is staggered with a corresponding side surface of the first accommodating groove vertically.

9. An electrical connector, configured to be electrically connected to a mating plug, comprising:

a body, comprising a mating cavity defined by a top plate, a bottom plate and two side plates, the mating cavity allowing insertion of an insertion portion of the mating plug, wherein the top plate and the bottom plate are located at upper and lower sides of the mating cavity, the two side plates are located at left and right sides of the mating cavity, the mating cavity has a center line, the top plate and the bottom plate are provided with a plurality of first accommodating groves, at least one of the first accommodating grooves is respectively disposed at a left side and a right side of the center line, the first accommodating grooves are communicated with the mating cavity and adjacent to the corresponding side plate, and each of the first accommodating grooves has a left wall surface and a right wall surface disposed oppositely in a left-right direction;

a plurality of terminals, correspondingly accommodated in the first accommodating grooves, each of the terminals having an elastic portion accommodated in the corresponding first accommodating groove, the elastic portion protruding into the mating cavity and mating with the insertion portion, wherein for each of the at least one of the first accommodating grooves located at the left side of the center line and a corresponding terminal of the terminals located at the left side of the center line, a clearance between the elastic portion of the corresponding terminal and the left wall surface of the first accommodating groove is greater than a clearance between the elastic portion of the corresponding terminal and the right wall surface of the first accommodating groove, and for the at least one of the first accommodating grooves located at the right side of the center line and a corresponding terminal of the terminals located at the right side of the center line, a clearance between the elastic portion of the corresponding terminal and the left wall surface of the first accommodating groove is smaller than a clearance between the elastic portion of the corresponding terminal and the right wall surface of the first accommodating groove; and a shell, having a top wall and two side walls bending and extending downward from two opposite sides of the top wall, wherein a mating port is defined by front ends of the top wall and the two side walls, the mating port is larger than the mating cavity, the top wall shields the top plate and protrudes forward beyond the top plate, and each of the side walls shields the corresponding side plate and protrudes forward beyond the side plate.

10. The electrical connector of claim 9, wherein each of the top plate and the bottom plate are further provided with at least one second accommodating groove respectively, the first accommodating grooves are located on left and right sides of the at least one second accommodating groove, a width of each of the first accommodating grooves is greater than a width of each of the at least one second accommodating groove, a first partition is provided between two of the first accommodating grooves, a second partition is provided between the first accommodating grooves and the at least one second accommodating groove, and a width of the first partition is smaller than a width of the second partition.

11. The electrical connector of claim 9, wherein the first accommodating grooves are bilaterally symmetric along the center line, the terminals are of a same structure, and distances between each two adjacent ones of the terminals are equal.

12. The electrical connector of claim 9, wherein the elastic portion is provided with two chamfers respectively at two opposite sides thereof, each of the chamfers extends to a free end of the elastic portion, a front end of each of the accommodating grooves has a front wall surface, and the free end of the elastic portion is accommodated in the corresponding one of the accommodating grooves and shielded by the front wall surface.

13. The electrical connector of claim 9, wherein a partition is provided between two adjacent ones of the first accommodating grooves, a plurality of ribs respectively protrudes from the partitions into the mating cavity, and a front end of the body has a guide chamfer extending from an opening of the mating cavity to front ends of the ribs.

14. The electrical connector of claim 13, wherein the body has a connecting portion connecting the front ends of at least two ribs, a height of the connecting portion and a height of the ribs are identical, and the guide chamfer extends to a front end of the connecting portion.

15. The electrical connector of claim 13, wherein a side surface of at least one of the ribs is staggered with a side surface of the corresponding first accommodating groove vertically.

* * * * *